United States Patent [19]

Morino

[11] Patent Number: 4,596,914

[45] Date of Patent: Jun. 24, 1986

[54] MICROWAVE OVEN WITH A MOTOR DRIVEN ELECTRIC HEATER

[75] Inventor: Taisuke Morino, Suita, Japan

[73] Assignee: Sharp Kabushiki Kaishi, Osaka, Japan

[21] Appl. No.: 716,921

[22] Filed: Mar. 28, 1985

[51] Int. Cl.[4] ..... H05B 6/64

[52] U.S. Cl. ..... 219/10.55 B; 219/10.55 E; 219/10.55 R; 219/400; 219/404

[58] Field of Search ..... 219/10.55 B, 10.55 E, 219/10.55 R, 10.55 F, 400, 403, 404, 408; 99/325, 451, DIG. 14; 126/21 A, 21 R

[56] References Cited

U.S. PATENT DOCUMENTS

| | | | |
|---|---|---|---|
| 3,522,414 | 8/1970 | Kramer | 219/404 |
| 4,357,513 | 11/1982 | Kawata et al. | 219/10.55 B |
| 4,488,025 | 12/1984 | Tanabe | 219/10.55 B |

*Primary Examiner*—Philip H. Leung

*Attorney, Agent, or Firm*—Birch, Stewart, Kolasch & Birch

[57] ABSTRACT

A motor drive for a heater in a microwave oven is disclosed which drives the rotation of the heater by the motor and controls the rotation of the motor with a control device to automatically position the heater suitably for cooking, thus preventing under or overcooking. A device is provided to permit the heater to rotate freely between a vertical position opposing a convection fan in the heating chamber and a horizontal position directly above a tray, a motor and transmission device are provided to drive the rotation of the heater, and a control device is provided to control the rotation of the motor.

5 Claims, 7 Drawing Figures

MICROWAVE OVEN WITH A MOTOR DRIVEN ELECTRIC HEATER

BACKGROUND OF THE INVENTION

This invention concerns a motor drive for a high frequency heater in the heating chamber of a microwave oven, which can freely rotate the high frequency heater between a vertical position for baking and microwave cooking, and a horizontal position for grilling.

Heaters located vertically in microwave ovens, opposing a convection fan in the back of the heating chamber, with which baking and microwave cooking were effected, which could be lowered to a horizontal position, directly above a tray in the heating chamber for broiling were available with conventional units. However, with the heater in the conventional microwave oven, positioning of the heating element was effected by moving a heater drive lever on the control panel. With this type of positioning, food was in some cases not browned properly, or the temperature in the oven differed from that desired if it was not positioned properly, resulting in over or under cooking of food.

SUMMARY OF THE INVENTION

The object of this invention is to eliminate the above problems by providing a motor drive device which has a motor to rotate the heater in the microwave oven, and a control device to control the rotation of the motor in order to automatically position the heater suitably to provide for no-fail cooking.

In order to achieve the above goal, means are provided to allow rotation of the heater in the heating chamber of the microwave oven from a vertical position opposing the convection fan, to a horizontal position directly above the tray; a motor drive is provided to rotate the heater; and a control device is provided to control the heater driving mechanism of the motor.

In the motor drive for the heater in the microwave oven in this invention which is composed of the components stated above, the control device controls the rotation of the motor according to the type of cooking, locating the heater in a suitable position, eliminating over or undercooking of food due to user error.

DETAILED DESCRIPTION OF THE INVENTION

Figure 1:
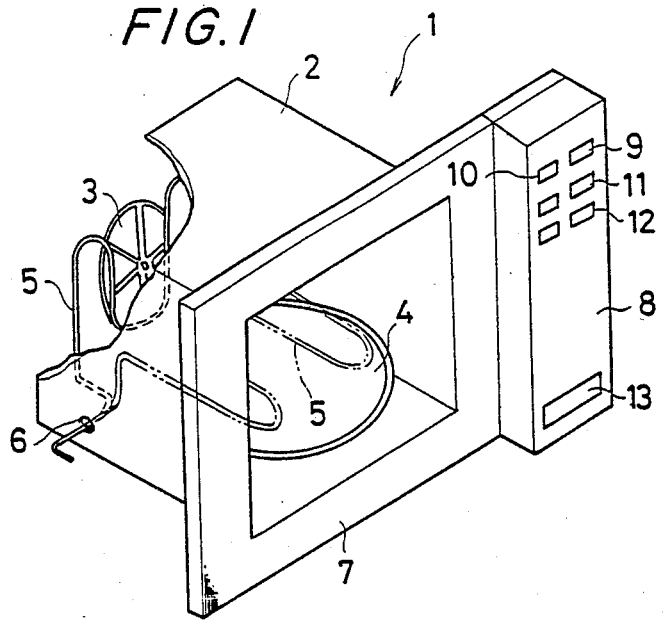
FIG. 1 shows an overall oblique view of the microwave oven, which is the embodiment of this invention.

As shown in FIG. 1, the microwave oven (1) is provided with a convection fan (3) on the front of the back wall of the heating chamber (2), and a tray (4) on the bottom of the heating chamber (2), which food to be cooked is placed on. A heater (5) which is bent back and forth is provided in the heating chamber (2), which can freely rotate by means of a pivot hole (6) provided in the side wall. This heater (5) rotates between a vertical position opposing the convection fan (3) and a horiztonal position directly above the tray (4). A door (7) is provided on the front of the microwave oven (1), and a control panel (8) beside it. A heater up button (9), heater down button (10), grill select button (11), grill auto button (12), heating button (13) and other buttons are provided on the control panel (8).

Figure 2:
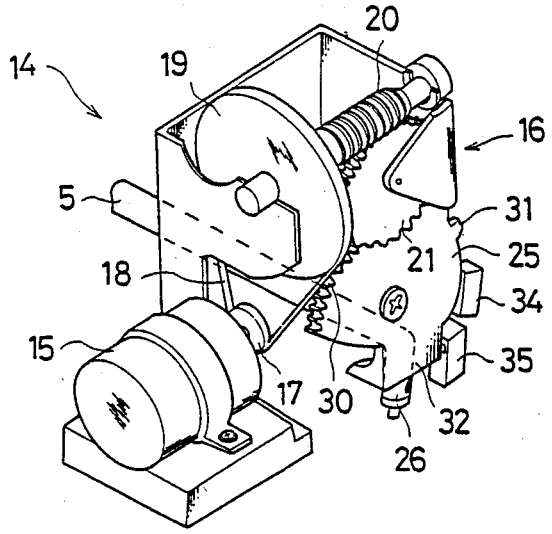
FIG. 2 shows a perspective view of the motor drive for the heater in this microwave oven, FIG. 3 a vertical sectional view of the motor drive mechanism for the heater in the microwave oven.
Figure 3:
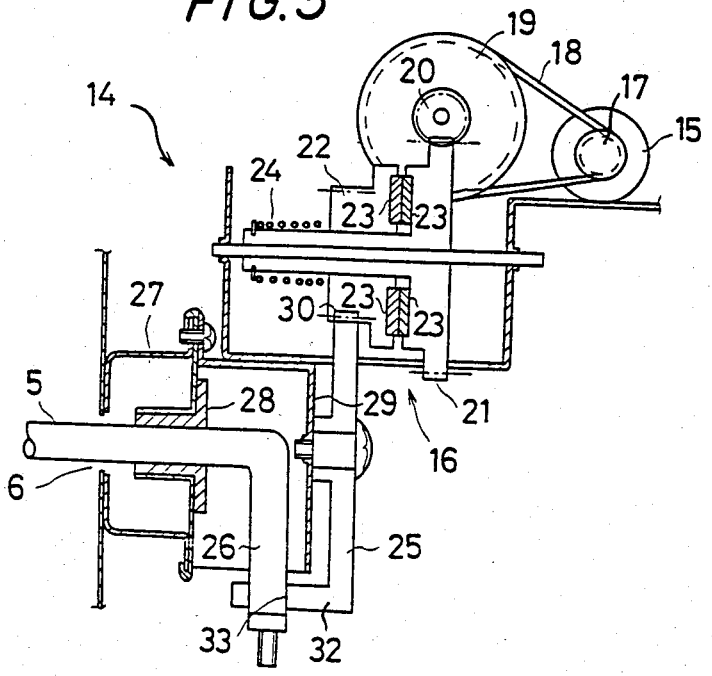

Rotation of the heater (5) in the heating chamber (2) is driven by the motor (14) drive mechanism of FIG. 2 provided on the outside of the hole (6) in the side wall. This motor drive mechanism (14) comprises a motor (15) and transmission device (16) as shown in FIGS. 2 and 3. The motor (15) is an AC motor which can be reversed by a control device. The transmission device (16) transmits the rotation of the motor (15) to the heater. The rotation of the motor (15) is first reduced by the small pulley (17), belt (18) and big pulley (19), and transmitted to the worm gear (20) which is on the same shaft as the big pulley (19). The rotation which has been transmitted to the worm gear (20) is reduced and transmitted to the worm wheel (21). A clutch gear (22) is mounted on the rotation shaft of the worm wheel (21) which allows free rotation and sliding in the thrust direction. Clutch linings, (23), (23) with a high abrasion factor are firmly fixed to the surfaces of the clutch gear (22) and worm wheel (21) which face each other, and the clutch gear is strongly pressed against the worm wheel (21) by a compression coil spring (24) which is mounted on the worm wheel (21). The rotation that is transmitted to the worm wheel (21) is thus transmitted to clutch gear (22) shown in FIG. 3 at a torque transmission ratio of 1:1. The rotation that is transmitted to the clutch gear (22) is further reduced and transmitted by heater drive gear (25). The rotation that is transmitted to the heater drive gear (25) is finally transmitted to the heater (5). The heater (5) sticks out of the hole (6) provided in the side wall of the shown in FIG. 3, and the end of the heater 26 that sticks out is bent perpendicular with respect to the rotation shaft. A heater choke (27) to permit penetration of the heater (5) and choke insulation (28) are provided around the outside of the hole (6), which serve as a bearing for the heater (5), prevents leakage of microwaves and serves as a double insulation for the heater (5). A heater drive angle (29) is fixed to the heater choke (27), and the heater drive gear (25) of the transmission device (16) is mounted to the heater drive angle (29) in such a way that it can freely rotate, to be integral with the rotation shaft of the heater (5). The heater drive gear (25) is provided with a sector gear (30) with a rotation angle of 90 degrees or more, and a small projection (31) and L shaped projection with the end bent on the periphery other than the sector gear (30). The sector gear (30) transmits rotation to the heater drive gear (25) by meshing with the clutch gear (22). A hole (33) is provided in the end of the L shaped projection (32) which is bent, and the rotation of the heater drive gear (25) is transmitted to the heater (5) by fitting the end of the heater (5) in the hole (33). The motor (15) thus drives the heater (5) through the transmission device (16). If, for example, the rpm of the motor is 5000, and the reduction ratio of the transmission device is 1/1000, the heater can be rotated from the vertical to the horizontal position in about 3 seconds.

Figure 4:
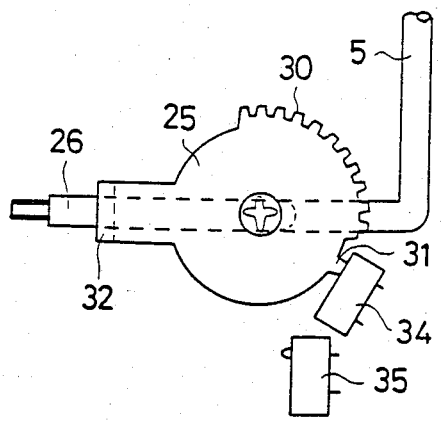
FIGS. 4 and 5 are side views of the heater drive gear section to explain the operation of the motor drive, FIG. 6 a block diagram of the control device for the motor drive for the heater in this microwave oven, and FIG. 7 a flow chart showing the operation of the microwave oven.
Figure 5:
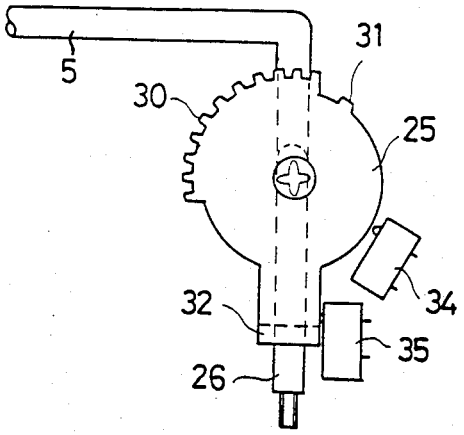
Figure 6:
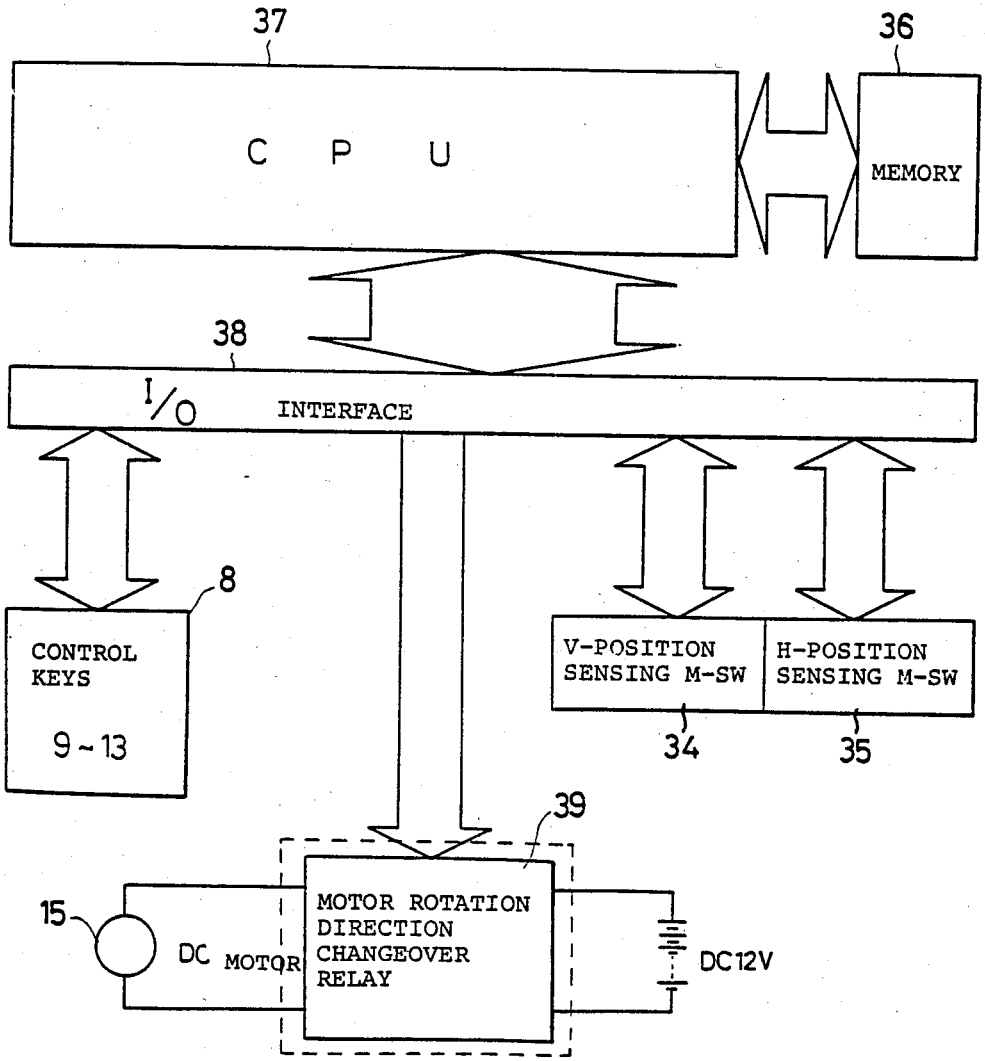

A microswitch (34) to detect the vertical position of the heater (5) and another microswitch (35) to detect the horizontal position of the heater (5) are provided around the rotating arc of the heater drive gear (25) as shown in FIGS. 4 and 5, with the small projection (31) on the heater drive gear (25) pressing against the vertical position detecting microswitch (34) to turn it ON when the heater is in the vertical position, as shown in FIG. 4, and the L shaped projection (32) of the heater drive gear (25) pressing against the horizontal position detecting microswitch (35) to turn it ON when the heater (5) is in the horizontal position.

The control device which controls the rotation, stopping and direction of rotation of the motor (15), comprises a CPU (37) to which a memory (36) is connected, with signals from the control keys 9–13 on the control panel (8), and signals from the vertical position detecting microswitch (34) and horizontal detecting microswitch (35) taken in from the I/O interface (38), and a control signal output to the motor rotation changeover relay (39) to operate the motor (15). When the heater down button (10) is pressed, the control device drives the motor (15) in the forward direction to move the heater (5) towards a horizontal position from a vertical position. If the heater down button is released while the heater is being lowered, the rotation of the motor (15) stops, stopping the heater (5) at an intermediate position, permitting the heater (5) to be stopped at an arbitrary position. The heater (5) is moved until the horizontal position detecting microswitch (35) is turned ON if the heater down button (10) is held. Input of the heater down button (10) is not accepted while the horizontal position detecting microswitch (35) is ON. When the heater up button (9) is pressed, the control device causes the motor (15) to rotate in the reverse direction, moving the heater (5) towards a vertical position from a horizontal position. The rotation of the motor (15) also stops when the heater up button (9) is released, stopping the movement of the heater (5) at an intermediate position, allowing the heater (5) to be located at an arbitrary position. If the heater up button (9) is held, the heater (5) continues to move until it is stopped at the vertical position when the vertical position detecting microswitch (34) goes ON. Input of the heater up button (9) is not accepted while the vertical position detecting microswitch (34) is ON.

Figure 7:
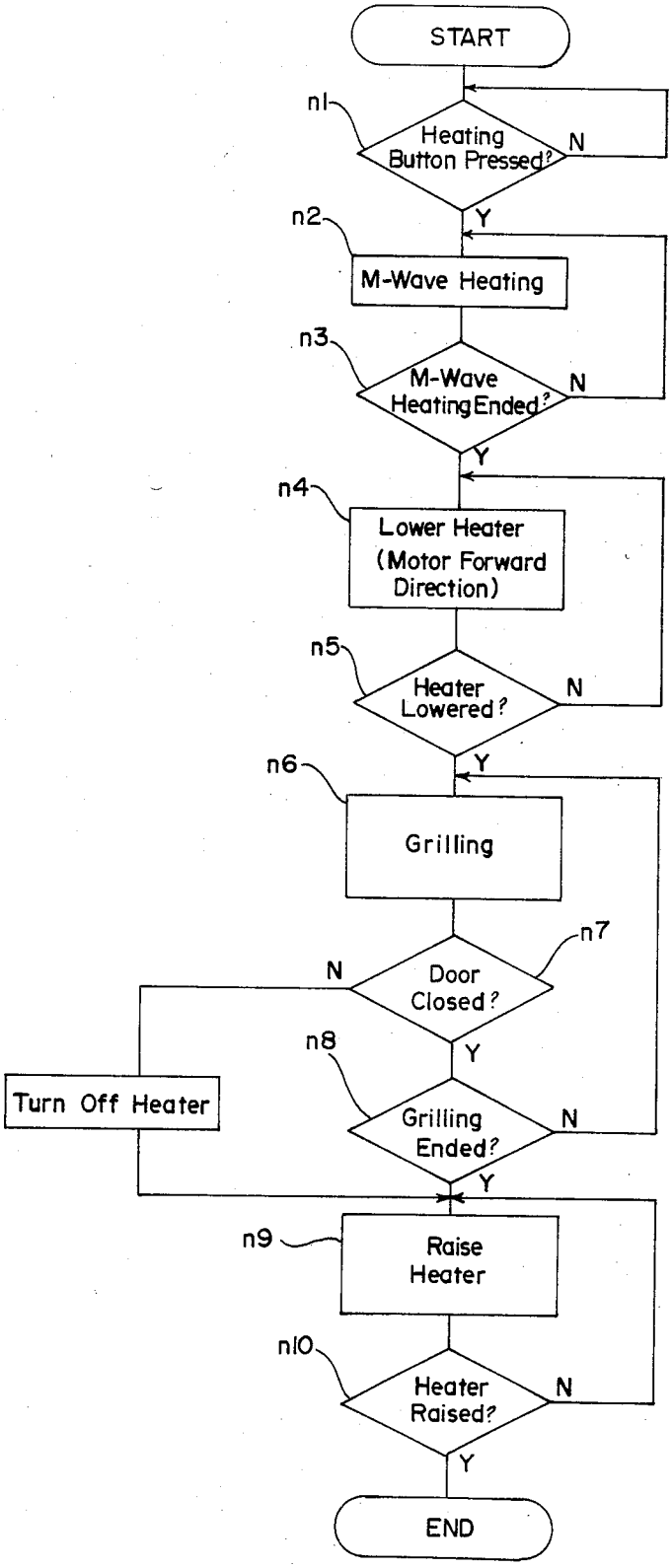

The operation of the grill auto button (12) on the control panel (8) of the mcirowave oven (1) will now be explained, using FIG. 7.

In step nl, when the user presses the heater button (13), microwave heating is commenced (n2). When microwave heating ends (n3), the control device causes the motor (15) to rotate in the forward direction, moving the heater (5) towards the horizontal position from the vertical position (n4). When the heater (5) stops at the horizontal position (n5), grilling is commenced (n6). While the door (7) remains closed (n7), the control device causes the heater (5) to be moved towards the vertical position (n9) when grilling ends (n8). When the heater (5) stops at the vertical position (n10), cooking is finished. Furthermore, if the door (7) is opened during grilling (n7), the heater (5) is turned off (n11), the control device goes to n9, and the heater (5) is raised to the vertical position. This prevents the possiblity of the user inadvertently touching the heater (5) and burning his/her hand.

The transmission device (16) of the motor drive for the heater transmits the rotation of the motor (15) through the worm gear (20) and worm wheel (21). This prevents an variation in position of the heater (5) due to its own weight. However, in the transmission device (16) there is a slip clutch mechanism which comprises clutch linings (23), (23) fixed to opposing surfaces of the worm wheel (21) and clutch gear (22), which are held together by a compression spring (24). Rotation is transmitted through this slip clutch, so that when external force is applied, the slip clutch mechanism slips, allowing the heater (5) to be moved. This prevents the heater (5) from getting in the way by allowing it to be moved to an arbitrary position when the unit is unplugged in order to clean the inside of the heating chamber (2) of the microwave oven (1).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A microwave oven with a motor drive mechanism for an electric heater which comprises:
   - a heating chamber including a back wall, said walls and bottom tray;
   - a microwave generator for generating microwaves in said heating chamber;
   - a convection fan mounted on said back wall of said heating chamber;
   - a heater provided in said heating chamber, freely rotatable between a vertical position opposing said convection fan and a horizontal position above said bottom tray; and
   - a motor drive mechanism for rotating said heater provided outside said heating chamber and connected via a rotation shaft to said heater through a hole in one of said side walls of said heating chamber, said motor drive mechanism comprising a motor and transmission device, said transmission device comprising a pulley system for reducing rotation of said motor which is transmitted to said heater by way of a worm gear and worm wheel combination, a clutch gear mounted on a rotation shaft of said worm wheel, said clutch gear pressed against said worm wheel by a compression spring mounted on said worm wheel and a heater drive gear.

2. The microwave oven of claim 1, further comprising a control device which controls the rotation, stopping and direction of rotation of the motor for selectively positioning said heater in said heating chamber.

3. The microwave oven of claim 2, wherein said control device comprises a CPU with memory and said microwave oven further includes a control panel for operating said motor by way of said control device.

4. The microwave oven of claim 1, further including a first microswitch to detect the vertical position of the heater and a second microswitch to detect the horizontal position of the heater, both microswitches being provided around a rotating arc of said heater drive gear.

5. The microwave oven of claim 4, wherein said heater drive gear is provided with a projection on said heater drive gear for pressing against said vertical positioon detecting a microswitch to turn it on when said heater is in a vertical position and a L-shaped projection for pressing against said horizontal position detecting microswitch to turn it on when the heater is in the horizontal position.

* * * * *